US005440461A

United States Patent [19]

Nadel et al.

[11] Patent Number: 5,440,461

[45] Date of Patent: Aug. 8, 1995

[54] LIGHT ILLUMINATING ASSEMBLIES FOR WEARING APPAREL WITH LIGHT ELEMENT SECUREMENT MEANS

[76] Inventors: Craig P. Nadel, 201 Wingate Rd., Parsippany, N.J. 07054; Dietmar Nagel, 11 South Rd., Chester, N.J. 07930

[21] Appl. No.: 237,021

[22] Filed: May 2, 1994

[51] Int. Cl.[6] ..... F21L 15/08

[52] U.S. Cl. ..... 362/103; 362/800

[58] Field of Search ..... 362/103, 106, 108, 800

[56] References Cited

U.S. PATENT DOCUMENTS 4,570,206 2/1986 Deutsch ..... 362/103

5,278,734 1/1994 Ferber ..... 362/103

FOREIGN PATENT DOCUMENTS 2497985 7/1982 France ..... 362/103

*Primary Examiner*—Carroll B. Dority

*Attorney, Agent, or Firm*—Cohen, Pontani, Lieberman, Pavane

[57] ABSTRACT

A light illuminating assembly having at least one light emitting element is operatively associated with an applied or intended decoration on the exterior of wearing apparel includes an improved assembly for securing the light emitting element thereto without the need for predetermined openings in the fabric of the apparel article for accommodating the light emitting elements. The securing assembly includes a two-piece enclosure for the light emitting element. A first piece of the enclosure has a central bore for receiving the light receiving element and defines a base flange portion which is adapted to contact the exterior surface of the apparel article. A second piece of the enclosure defines a recess dimensioned to receive the base flange portion, with a section of fabric interposed therebetween, in a press-fit locking manner. The electrodes of the light emitting element penetrate the fabric and are pressed into engagement with an electrically conductive pattern formed or carried on the interior surface of the interposed section of fabric.

14 Claims, 1 Drawing Sheet

LIGHT ILLUMINATING ASSEMBLIES FOR WEARING APPAREL WITH LIGHT ELEMENT SECUREMENT MEANS

BACKGROUND OF THE INVENTION

1. Field of the Invention

This invention relates generally to electrically controlled assemblies including a plurality of light emitting elements for illuminating decorations or designs on the exterior of wearing apparel such as T-shirts, hats and other accessories and, more particularly, to an improved securement means for non-detachably affixing each of the light emitting elements to the outer surface of the wearing apparel, garment, hat or other accessory for operative relation with the decoration or design to be illuminated and for electrical communication with current-carrying conductors.

2. Description of the Related Art

The use of light illuminating devices and assemblies having light emitting elements, such as Light Emitting Diode (LED) modules, for illuminating a decoration or a design applied, painted or printed on wearing apparel, garments, hats or other accessories is known. Typically, the LED modules are fastened or otherwise affixed to or through the outer surface of the wearing apparel, garments, hat or other accessory for illuminating the decoration or design. The circuit includes a power source, such as a battery, which is generally mounted within the article or garment and connected by a flexible electrical circuit board attached to the garment in a predetermined design or shape on the garment.

As heretofore practiced in, by way of example, a shirt, the electrical wiring may be covered by means of a secondary fabric or other suitable material stitched or otherwise adhered to the material of the shirt so as to encase the wires between the material of the shirt itself and the backing fabric. A suitable switch block means or the like extends from the wiring, which is essentially sandwiched between the two pieces of fabric, and the battery pack may be electrically connected with the switch block means for supplying current to the electrical wiring system of the shirt. When the electrical system is energized, the diodes emit light. The diodes may be arranged on the front or outer surface of the shirt in accordance with a particular design or pattern applied to the shirt, and may be programmed for intermittent energization whereby the lights blink in accordance with a preselected sequence, thus providing an interesting effect for the decorated shirt. For examples of prior patents relating to light illuminating devices and assemblies and to various ways of affixing the LED modules into an assembled position to accomplish the desired coaction with such decorations or designs, reference may be had to U.S. Pat. Nos. 4,570,206, 4,599,682, 4,709,307, 4,823,240, 4,480,293, 5,113,325, and 5,113,329.

One disadvantage of the lighted apparel currently available is the relatively large number of electrical wires that must be incorporated in the garment to achieve the desired visual effect. In the case of a T-shirt, the wires have an inherent bulkiness that is readily felt as they press against the body of the wearer of the shirt, which is a serious disadvantage, and the cleaning or washing of the shirt without damage to the wires (or unintended loss of LED's) presents an imposing problem. In addition, the use of fixed apertures in the garment material requires that the LED's be placed only in pre-set locations on the garment. The battery pack, moreover, is not typically removable from the garment to facilitate cleaning or washing of the garment.

In order to improve upon and overcome the serious deficiencies in previously devised illuminated articles of wearing apparel, it would be desirable to provide an illuminated article, preferably an article of wearing apparel or a flotation device, in which the illumination devices, such as LED's, may be easily positioned in any design or location on the article. It would also be desirable to provide an illuminated article in which the illuminating devices are easily attachable to an electric circuit and power source formed on the interior surface of the garment or article. It would be additionally advantageous to provide an illuminated article in which the light emitting elements and conductors are substantially sealed and protected against damage so as to facilitate washing and tumble drying of the article itself. Finally, it would be desirable to provide an illuminated article in which the illumination circuit mountable on the article or garment provides an aesthetically pleasing appearance when the illumination devices are not activated.

SUMMARY OF THE INVENTION

The present invention provides an improved light illuminating device or assembly in which novel securement means for the light emitting element serve to positively secure the light emitting elements into assembled position relative to the decoration or design on any article of wearing apparel by a simple and effective arrangement which facilitates the positioning of the light emitting elements in contact with a circuit pattern formed on the interior surface of the apparel fabric.

Thus, in accordance with one aspect of the present invention, the electrically operated light illuminating device or assembly for use on wearing apparel having a decoration or design on the exterior includes at least one light emitting element projecting from an exterior portion of the wearing apparel at the point thereon at which the decoration or design is located, a source of electrical power, a controller for actuating the light emitting elements, connecting means for connecting each of the light emitting elements to the source of electrical power, and a two piece securing assembly for retaining each light emitting element in a respective desired location.

The securing assembly includes a first piece having a central bore for receiving the light receiving element and defining a base flange portion which is adapted to contact the exterior surface of the apparel article. A second piece of the securing assembly defines a recess dimensioned to receive the base flange portion, with a section of fabric interposed therebetween, in a press- or snap-fitting manner.

In accordance with another aspect of the present invention, the connecting means includes a pattern of electrically conductive ink applied to or otherwise formed on the interior surface of the apparel fabric. The light emitting element is inserted into the bore defined in the piece and the bottom surface of the base flange portion is pressed into engagement with the exterior surface portion of the fabric at a desired location relative to the design or decoration applied thereto and opposite the conductive ink pattern. In so doing, the electrodes of the light emitting element penetrate the fabric and are pressed between the base flange of the first piece and an aligned surface of the second piece into engagement with the electrically conductive pattern formed on the interior surface of the interposed section of fabric.

It is another aspect of the present invention that in the embodiments hereinafter described, the first piece of the securing assembly includes an elongated generally cylindrical tubular section in which the light emitting element is mounted. The base flange of the first piece extends radially outward from a portion of the periphery of the tubular section. The second piece of the securing assembly defines a cavity having a substantially circular opening, an interior base surface, and at least one interior sidewall surface. The interior sidewall has a peripheral bead portion that defines the circular opening.

The base of the first piece is press fit into the cavity of the second piece until the prongs of the light emitting element are pressed into engagement with the conductive strips formed on the interior of the fabric section therebetween interposed. The peripheral bead portion locks the first and second sections together to provide a durable, impact and disengagement resistant housing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals depict similar elements throughout the several views.

DETAILED DESCRIPTION OF THE PREFERRED EMBODIMENTS

Figure 1:
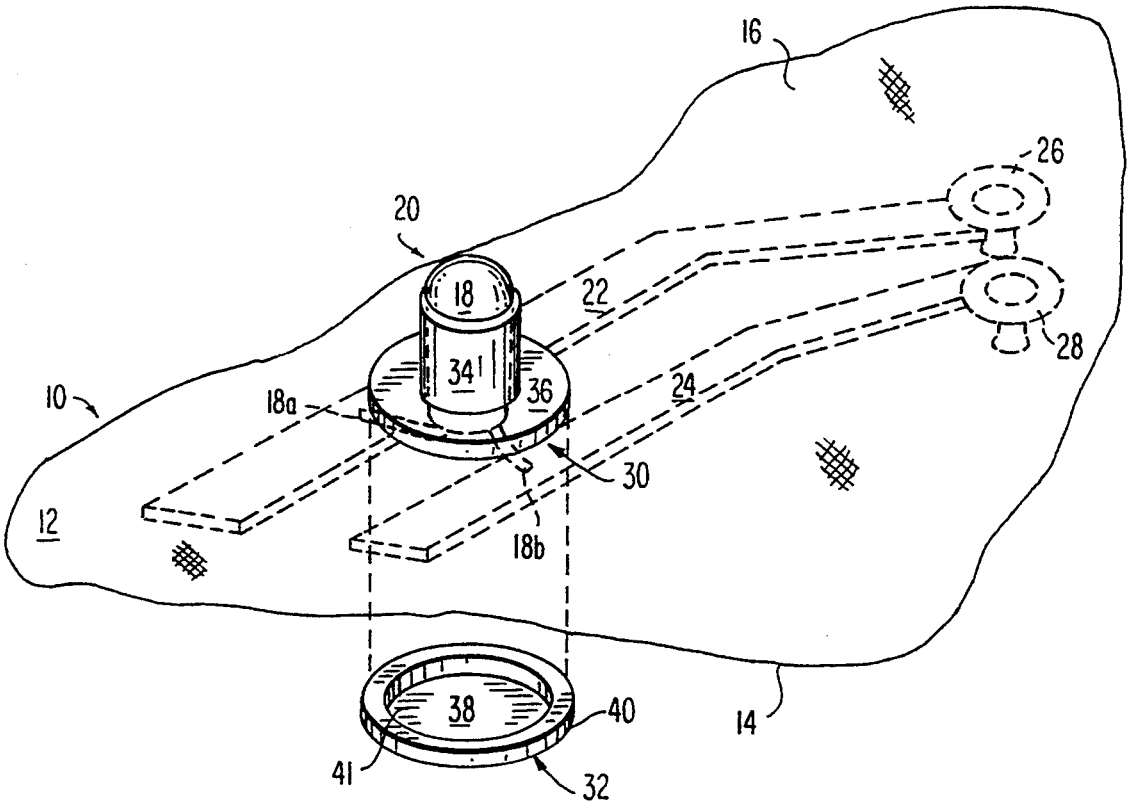
FIG. 1 is an exploded perspective view of a portion of an article of wearing apparel having a decoration on the front panel and showing generally an improved light illuminating assembly constructed in accordance with teachings of the present invention.

With initial reference to FIG. 1, there is shown a partial exploded view of a an article of wearing apparel, such as a T-shirt, generally designated 10 and having a front panel 12. The front panel 12 defines a space or region at the interior or inner face 14 of the T-shirt and, on the exterior or outer face 16 of the front panel 12, a decoration (not shown) may optionally be imprinted, hot stamped, hand drawn or otherwise applied or affixed. Wearing apparel, and more particularly T-shirts, bearing decorations, designs, slogans or other markings or devices on their front panel, rear panel, and/or sides and the like are well known in the marketplace and the T-shirt portion herein depicted is only intended to representatively illustrate the manner in which a plurality of light emitting elements 18 or the like may be arranged on and affixed thereto (or to any garment or substrate) utilizing the two-piece securing assembly 20 of the present invention.

In any event, the interior face surface of front panel 12 carries a pair of electrically conductive strips 22 and 24 formed thereon. In accordance with a preferred embodiment of the present invention, conductive strips or traces 22, 24 are defined by affixing to the surface a patterned application of a conductive ink material. Such conductive materials are well known and commercially available. It will, however, be recognized by those skilled in the art that the conductive strips 22, 24 may alternatively be formed utilizing any suitable electrically-conductive material. As shown in FIG. 1, the strips 22, 24 are respectively connected to corresponding power source terminals 26, 28. Each of the power source terminals is formed of an electrically conductive metal or metal alloy and each is preferably configured with an upstanding projection for mating engagement with the power terminals of a detachable power source/control module (not shown). It will therefore be readily appreciated that the construction of the power source terminals 26, 28 facilitates ready removal of the power supply from the garment or article 10 prior to machine washing and drying, other situations of rough handling, or extended periods of non-use.

Figure 2:
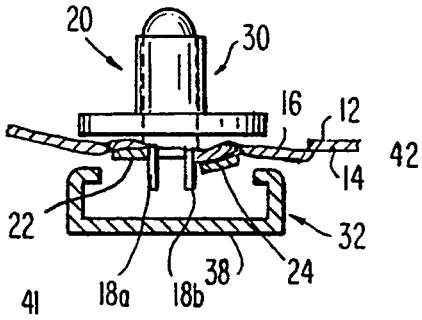
FIG. 2 is an exploded cross-sectional view of the two-piece, snap-fitting lamp securing assembly of FIG. 1.

With reference now to FIGS. 1 and 2, the construction of the lamp securing assembly 20 will now be described in detail. As shown in FIG. 1, securing assembly 20 includes a first part or member 30 and a second part or member 32, both of which may be formed of a plastic or thermoplastic material. Preferably, the plastic material has a light color, such as white, to minimize its visibility when the light emitting elements are not activated. First member 30 includes a cylindrical, tubular section 34 and a base flange portion 36 projecting radially outwardly from a portion of the lower periphery of the tubular section 34. An axial bore dimensioned to receive a typical light emitting element 18 extends through the first member 30. In the illustrative embodiment depicted in FIG. 1, base flange portion 36 is configured as a single contiguous projection which has first and second arcuate edges and first and second straight edges (only one of which is shown). As will soon be described in detail, this configuration of the base flange portion facilitates its insertion into a cavity defined in the second member 32 and thus permits interlocking of the same. It will, however, be readily appreciated that other base flange configurations are possible. For example, the base flange may be configured as two or more symmetrically disposed radial portions that project radially along the periphery of the base of tubular section 34.

Second member 32, which is essentially configured as a locking cap member, includes a substantially flat, disk-like interior base 38 and an upstanding sidewall portion 40 extending from at least a portion of the periphery of the base to define a cavity 41 dimensioned and arranged to receive the base flange 36. In accordance with an illustrative embodiment of the present invention, upstanding sidewall 40 surrounds base 38 so that cavity 41 has a substantially circular cross section. It will, of course, be appreciated that sidewall 41 may be configured as two or more symmetrically arranged, spaced-apart portions engageable with corresponding portions of the base flange. As best shown in FIG. 2, the upper portion of the sidewall has a projecting rim portion or peripheral bead 42. For a reason that will be explained below, the cavity 41 is dimensioned to permit the base flange 36 to be substantially nondetachably snap-fit into the cavity such that a section of the front panel 12 is firmly pressed and retained between the bottom surface of the base flange 36 and the interior surfaces of the cavity 41.

The interengagement or assembly of the first and second members 30 and 32 for securing a light emitting element 18 to the exterior face of front panel 12 will now be described. As shown in FIG. 2, a light emitting element 18 is inserted into the axial bore defined in the first member 30 so that the outwardly projecting wire or prong-type electrodes 18*a*, 18*b* thereof extend downwardly beyond the bottom surface of base flange 36. The first member 30, with the light emitting element 18 accommodated or retained thereby, is positioned at a desired location on the exterior face of the front panel 12. Subsequently, and in the manner shown in FIG. 1, the prong electrodes are pushed through the front panel 12 of the article in a region thereof lying between conductive strips 22, 24, and the member 30 is displaced until the bottom of its flange portion 36 abuts the exterior face of the front panel 12.

Assembly of the securing means 20 is completed by bending the electrodes 18a, 18*b* so that they overlie and contact the respective conductive strips 22, 24, and then aligning second member 32 with first member 30 and light emitting element 18 so that the cavity 41 is positioned to receive the base flange 36 and electrode prongs 18*a*, 18*b* with the section of front panel 12 interposed therebetween. The first and second members 30 and 32 may then be snap-fit together by applying pressure to the respective upper and lower surfaces thereof. It will be understood that the use of a moldable plastic material enables sufficient temporary deformation of the sidewall 40 to accommodate captured insertion of the base flange 36, while return of the sidewall to its initial shape will provide a durable, interlocking, substantially non-detachable connection and interengagement. More significantly, by connecting the first and second members in the above-described manner, the electrode prongs 18*a*, 18*b* are forced into contact with the respective conductive strips 22, 24. In this manner, a reliable, impact-resistant electrical connection is achieved.

From the foregoing, it will be appreciated that the present invention provides significant benefits and advantages over prior art illuminated articles. For example, the use in accordance with the present invention of interlocking components respectively positioned on the interior and exterior surfaces of the illuminated article, with the article cloth or substrate interposed therebetween and only the two prongs of the light emitting element projecting through the substrate, obviates the need to define holes in or through the section of fabric or other flexible sheet material, as was previously required, for mounting or accommodating the light emitting elements. Additionally, the use of a detachably-connectable plug-in power supply/controller module and of impact-resistant, substantially non-detachable light emitting element securing means results in an illuminated article that may be machine washed and dried without causing unintended damage to or unintended disengagement of the assembly. Moreover, by positioning only the thin profile second member on the interior face of the article, it is possible to construct T-shirts and other articles of wearing apparel which do not irritate the skin of the wearer and which avoid the uncomfortable, bulky configurations associated with the prior art. Further, the two-piece construction of the connecting assembly makes it possible to reconfigure an existing illuminated design by securing additional lights thereto, so long as suitable conductive strips or traces are either already present or may be added.

It will also be readily apparent that a wide variety of modifications to the interlocking securing means of the present invention are possible. For example, instead of configuring the LED and first member as individual components, it is possible to integrally incorporate the structural features of the first member that enable interlocking engagement with the second member 32 into the LED module itself. That is, the outer casing of the LED or other light emitting element may be constructed with a unitary base flange portion dimensioned and arranged for interlocking engagement with the sidewall(s) of second member 32. The configurations or shapes of the first member flange and of the second member sidewall may also be suitably modified so long as the two remain interlockingly engageable as discussed hereinabove.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended hereto.

What is claimed is:

1. An assembly for affixing a light emitting element having a pair of outwardly projecting electrode prongs to an article of wearing apparel having at least one substantially flexible section and a conductive pattern carried on an interior surface of the flexible section, comprising:

a first member defining an axial bore dimensioned and arranged to receive said light emitting element and having a base flange portion for placement on an exterior surface portion of the flexible section; and a second member including a base and at least one sidewall portion dimensioned and arranged to receive said base flange in a captive snap-fitting manner with the second member and positioned on the interior surface of the flexible section, wherein the light emitting element is positionable within said axial bore such that the prongs thereof are inserted through the flexible section and wherein said second member is engageable with a portion of said interior surface aligned with said axial bore such that the element prongs are pressed into electrically-conductive contact with the conductive pattern.

2. The assembly according to claim 1, wherein said first member includes a substantially cylindrical tubular section for receiving and accommodating at least a portion of the light emitting element.

3. The assembly according to claim 2, wherein said base flange portion extends radially outwardly from a peripheral edge region of said tubular section.

4. The assembly according to claim 1, wherein said first and second members are formed of a moldable plastic material.

5. The assembly according to claim 1, wherein said second member includes an interior base surface, said interior base surface and said one at least one sidewall defining a cavity having a circular cross section.

6. The assembly according to claim 5, wherein said interior sidewall includes a peripheral bead portion that defines a circular opening of said cavity, said bead portion being engageable with said base flange portion to retain the same in a light emitting element retaining position.

7. An apparatus for forming an illumination pattern on an outer surface of a section of flexible sheet material, said apparatus comprising:

a plurality of light emitting elements for securement to the outer surface, each of said light emitting elements having a pair of outwardly projecting electrode prongs;

at least one flexible conductor pair carried on an interior surface of said flexible sheet material;

means connected to said flexible conductor pair for detachable securement to a power source for supplying power to each of said plurality of light elements; and a plurality of means for securing the electrode prongs of said light emitting elements to said flexible conductor pair and for substantially non-detachably retaining the light emitting elements to the section, each of said securing means including a first member defining an axial bore dimensioned and arranged to receive one of said light emitting elements and having a base flange portion for placement on an exterior surface portion of the flexible section, and a second member including a base and at least one sidewall portion dimensioned and arranged to receive said base flange in a captive snap-fitting manner with the second member and positioned on the interior surface of the flexible section, wherein a light emitting element is positionable within said axial bore such that the prongs thereof are inserted through the flexible sheet material and wherein said second member is engageable with an interior surface of said sheet material aligned with said axial bore such that the prongs are pressed into electrically-conductive contact with said flexible conductor pair.

8. The apparatus according to claim 7, wherein said first member includes a substantially cylindrical tubular section for receiving and accommodating at least a portion of said light emitting element.

9. The apparatus according to claim 8, wherein said base flange portion extends radially outwardly from a peripheral edge region of said tubular section.

10. The apparatus according to claim 7, wherein said first and second members are formed of a moldable plastic material.

11. The apparatus according to claim 7, wherein said second member includes an interior base surface and at least one sidewall for defining said cavity.

12. The apparatus according to claim 11, wherein said interior sidewall includes a peripheral bead portion that defines a circular opening of said cavity, said bead portion being engageable with said base flange portion to retain the same in a light emitting element retaining position.

13. An apparatus for forming an illumination pattern on a outer surface of a section of flexible sheet material, said apparatus comprising:

at least one light emitting element for securement to the outer surface, said light emitting element including a housing having a base surface and a pair of electrode prongs extending outwardly from said base surface;

means for securing said light emitting element to said section of flexible sheet material with said base surface facing an exterior surface of the section, said securing means including a first member engageable with an interior surface of said flexible sheet material;

said housing having an axial bore dimensioned and arranged to receive said light emitting element and having a radially outwardly extending base flange portion for placement on an exterior surface portion of the flexible section; and said first member including a base and at least one sidewall portion dimensioned and arranged to receive said base flange portion in a captive snap-fitting manner with the first member positioned on the interior surface of the flexible section.

14. An apparatus for forming an illumination pattern on an outer surface of a section of flexible sheet material, said apparatus comprising:

at least one light emitting element for securement to the outer surface, said light emitting element including a housing having a base surface and a pair of electrode prongs extending outwardly from said base surface;

means for securing said light emitting element to said section of flexible sheet material with said base surface facing an exterior surface of the surface of the section, said securing means including a first member engageable with an interior surface of said flexible sheet material; said light emitting housing including a radially outwardly extending flange portion proximate said housing base for placement on an exterior surface portion of the flexible section; and wherein said first member includes a base and at least one sidewall portion dimensioned and arranged to receive said flange portion in a captive snap-fitting manner with the first member positioned on the interior surface of the flexible section.

* * * * *